United States Patent [19]

Bell et al.

[11] Patent Number: 4,771,154

[45] Date of Patent: Sep. 13, 1988

[54] OVEN WITH FLUID HEAT TRANSFER FOR BROWNING FOOD INCLUDING A MICROWAVE ENERGY SOURCE

[75] Inventors: Geoffrey I. Bell, Havant; Michael H. C. Buttery, Tadworth, both of England

[73] Assignee: Thorn EMI Appliances Limited, London, England

[21] Appl. No.: 940,372

[22] Filed: Dec. 11, 1986

[30] Foreign Application Priority Data

Dec. 11, 1985 [GB] United Kingdom ..... 8530477

[51] Int. Cl.[4] ..... H05B 6/64

[52] U.S. Cl. ..... 219/10.55 B; 219/341; 219/399; 219/405; 219/411

[58] Field of Search ..... 219/10.55 R, 10.55 B, 219/10.55 E, 10.55 F, 341, 368, 405, 411, 399, 412

[56] References Cited

U.S. PATENT DOCUMENTS

| | | | |
|---|---|---|---|
| 4,453,064 | 6/1984 | Toyoda et al. | 219/10.55 E |
| 4,477,706 | 10/1984 | Mittelsteadt | 219/10.55 R |
| 4,481,405 | 11/1984 | Malick | 219/412 |
| 4,575,616 | 3/1986 | Bergendal | 219/405 |

FOREIGN PATENT DOCUMENTS

| | | | |
|---|---|---|---|
| 0072732 | 5/1980 | Japan | 219/405 |
| 0037426 | 4/1981 | Japan | 219/10.55 E |
| 0070323 | 4/1982 | Japan | 219/405 |
| 0202329 | 11/1984 | Japan | 219/405 |
| 2152790 | 8/1985 | United Kingdom . | |

OTHER PUBLICATIONS

G.E. Infrared Heating for People and Products, 8/73, p. 1.

*Primary Examiner*—G. P. Tolin
*Assistant Examiner*—Leon K. Fuller
*Attorney, Agent, or Firm*—Fleit, Jacobson, Cohn & Price

[57] ABSTRACT

An oven includes two tungsten-halogen lamp units strategically positioned, so that infra-red radiation generated by the units is emitted into the oven cavity to brown or grill food placed in the cavity. The cavity also includes, in one embodiment, an infra-red-reflective support for reflecting infra-red radiation emitted from the lamp units onto the underside of the food. In another embodiment, the support includes a heat transfer medium for absorbing infra-red radiation from the lamp units to produce heat and convey the heat to the underside of the food for browning. The oven may include a source of microwave energy and the support may have a microwave absorbent coating, which produces heat for browning the underside of the food.

5 Claims, 3 Drawing Sheets

OVEN WITH FLUID HEAT TRANSFER FOR BROWNING FOOD INCLUDING A MICROWAVE ENERGY SOURCE

This invention relates to ovens and in particular to such ovens including tungsten-halogen lamps as a means for browning food cooked by the microwave energy from a microwave source in the oven or for grilling food.

An oven of this type including a source of microwave energy is shown in our co-pending UK. Patent Publication No.2152790A, wherein in one embodiment two units, each containing two tunsten-halogen lamps, are strategically positioned around the oven cavity and communicate with the interior of the cavity, via respective openings in the cavity walls, the openings each being covered by a protective screen transmissive of infra-red radiation generated by the lamps.

The units are positioned to achieve an optimum browning effect of food placed in the oven cavity and suitable devices may be used to provide combinations of microwave energy to cook food and infra-red radiation from the lamps for browning, in accordance with a pre-set cooking programme.

However, whilst the oven described in the above-mentioned patent publication may achieve adequate browning of most foods, some types of food may require a generally uniform degree of browning over substantially its entire surface area, which would require the oven door to be opened and the food to be manually turned or generally moved within the cavity.

The inconvenience of having to turn the food also arises when the tungsten-halogen lamps are used to grill the food rather than to brown food cooked by microwave energy.

It is therefore an object of the present invention to provide an oven including browning or grilling facilities, which are substantially improved over those provided in ovens known hitherto.

In accordance with the present invention, there is provided an oven including at least one tungsten-halogen lamp emissive of infra-red radiation for browning or grilling food placed in the oven cavity, said at least one lamp being positioned to brown or grill predominantly regions of said food directly exposed to infra-red radiation from said at least one lamp, said cavity also including means for utilising infra-red radiation from said at least one lamp to brown or grill regions of said food obscured from said direct exposure.

The means for utilising infra-red radiation from the lamp units may consist of reflective means for reflecting the infra-red radiation towards the obscured regions, or alternatively it may consist of heat absorbent means arranged to convey heat from the infra-red radiation to the obscured regions.

The present invention will now be further described by way of example only with reference to the accompanying drawings, wherein.

Figure 1:
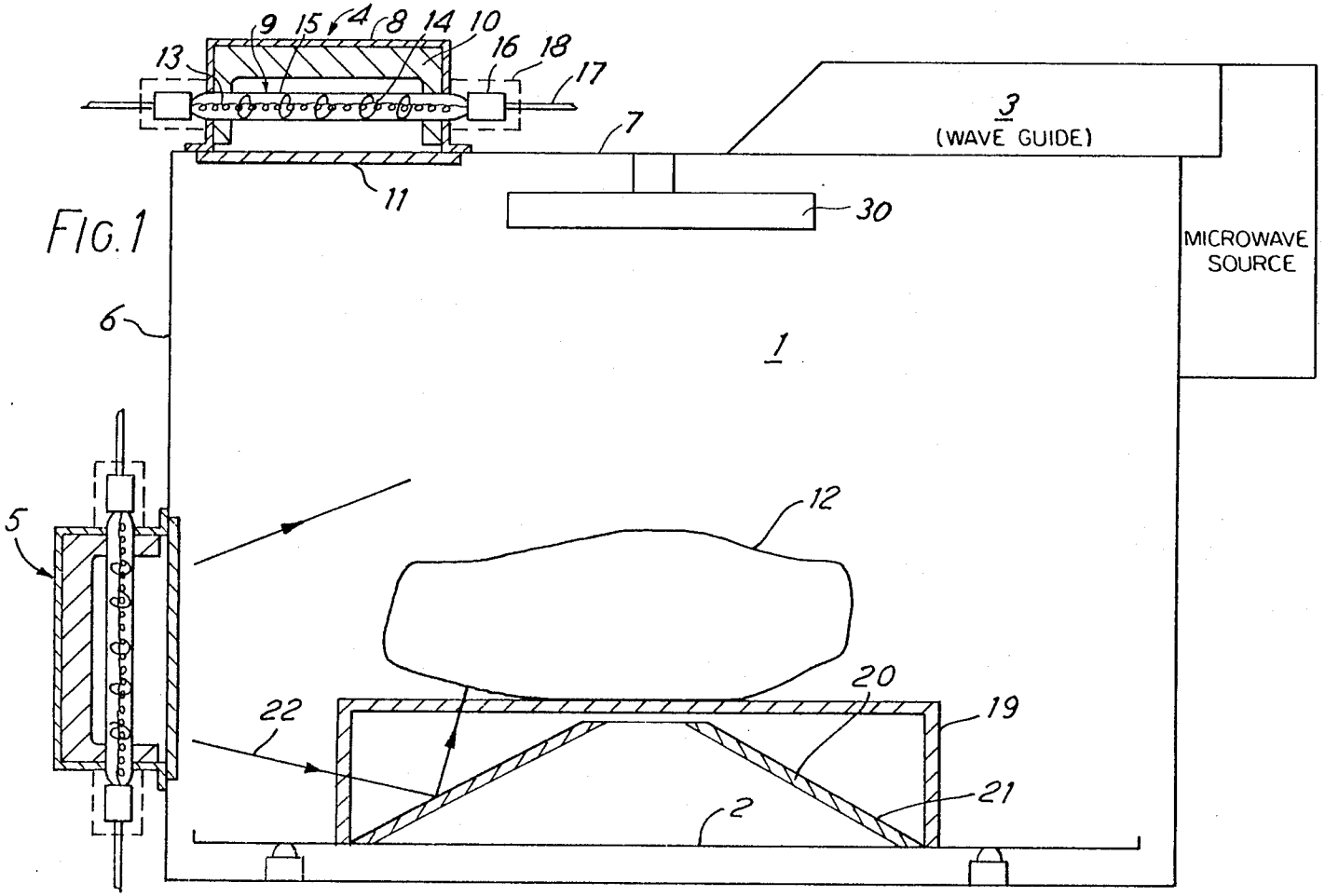
FIG. 1 shows schematically one embodiment of the invention.

Referring to the Figures, a microwave oven includes an oven cavity 1 containing a turntable 2. Microwave energy emitted from a microwave source is directed into the cavity by a conventional waveguide 3 to cook food 12 supported on the turntable 2.

Two tungsten-halogen lamp units 4, 5 are strategically positioned adjacent side wall 6 and top wall 7, respectively, of the cavity 1, so that infra-red radiation generated by the units is emitted into the cavity towards the food 12 to effect browning thereof.

Each unit 4 consists of a metallic casing 8 accommodating two tungsten-halogen lamps, such as at 9, emissive of infra-red radiation and supported by a thermally-insulative material 10, such as a suitable ceramic. The unit 4 is located adjacent an opening in the cavity wall 7, which is covered by a protective, infra-red-transmissive screen 11, preferably made of a glass ceramic material, which protects the lamp and interior of the unit 4 from mechanical damage and/or soiling caused by food particles emanating from the food 12 during cooking.

Each lamp 9 consists of a linear or coiled coil tungsten filament 13 supported within a tubular quartz envelope 15 by a number of spaced support coils 14. The envelope 15 is sealed at each end by pinch seals (not shown), each enclosed in a ceramic end cap 16, having an electrical connection between the filament 13 and a lamp lead 17 sealed therein. The envelope 15 is filled with an inert gas, such as argon or nitrogen with a halogen additive to provide a regenerative halogen cycle, which increases the longevity of the lamp.

The tungsten-halogen lamps generate radiation in the near-infra-red range within a wavelength band of 0.8–5 $\mu$m with a peak at approximately 1.2 $\mu$m.

To inhibit leakage of microwave energy from the cavity 1, via the lamp filament 13 and lead 17, each end of the lamp is enclosed within a microwave attenuating device, outlined at 18, such as a quarter wave choke. Alternatively, a microwave screen (not shown), which inhibits the passage of microwave energy into the lamp unit 4 may be printed onto the protective screen 11 or located separate from the screen 11 in any suitable position between the cavity 1 and the lamps.

The turnable 2 may be provided with variable and/or intermittent speed control to effect uniform browning of, for example, differently shaped food, such as bread.

By using the turntable 2 and the strategic positioning of the lamp units 4, 5, most surface regions of the food 12 are directly exposed to infra-red radiation and thus to browning.

However, to improve further the browning of the food, the present oven includes suitable means for using infra-red radiation from the lamp units 4, 5 to brown regions of the food 12 obscured from direct exposure to the radiation, particularly the underside region of the food, thereby removing the necessity of turning or otherwise moving the food.

Figure 2:
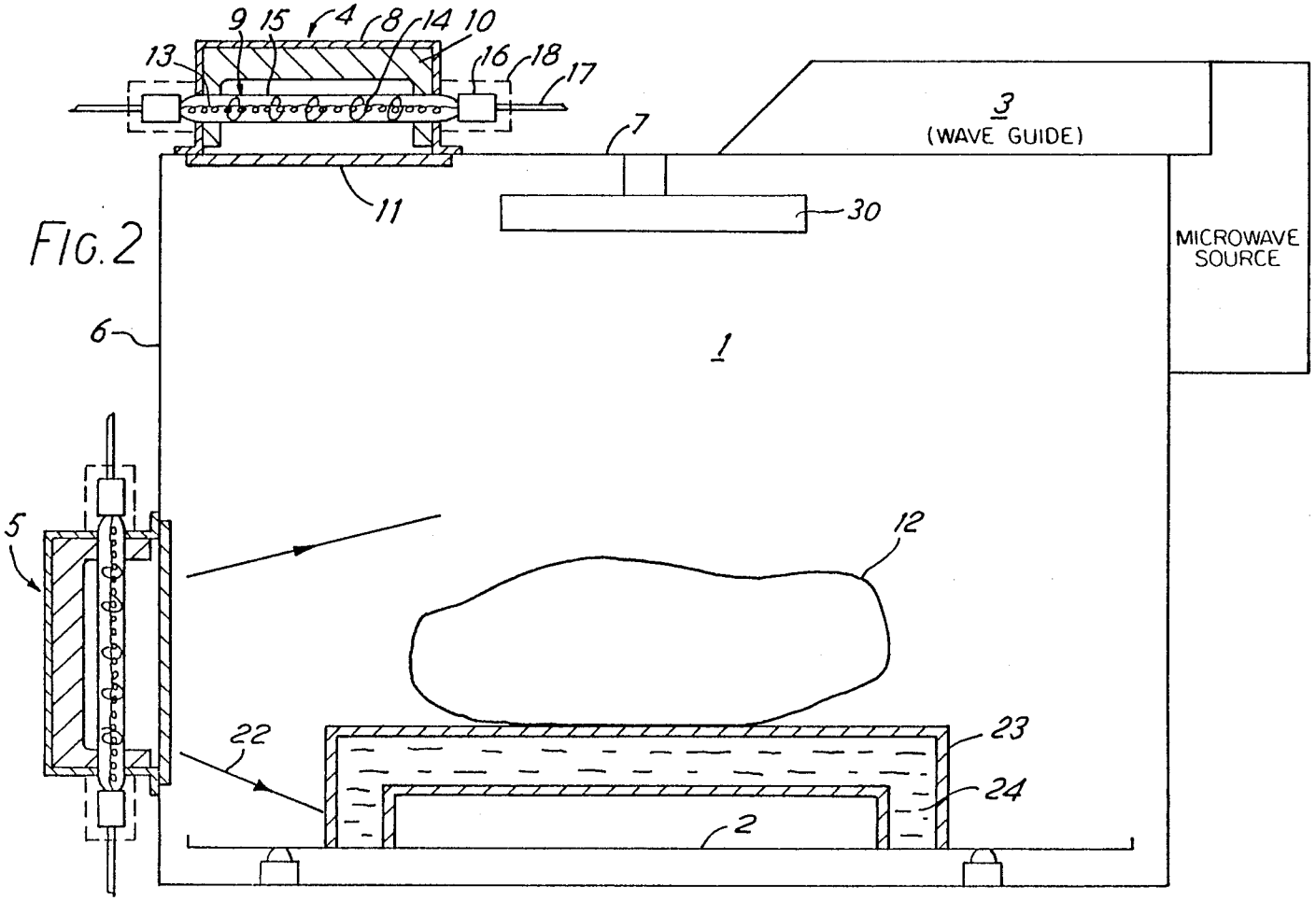
FIG. 2 shows schematically a second embodiment of the invention.

FIGS. 1 and 2 show two respective embodiments of a suitable means for achieving underside browning.

In FIG. 1, a support 19, positioned between the turntable 2 and the food 12, is formed from an infra-red transmissive material, such as a glass ceramic and contains a cone 20, having an infra-red-reflective surface 21 or a number of reflective facets (not shown).

Infra-red radiation 22, which is emitted from the lamp unit 5 and impinges on the reflective surface 21, after transmission through the support 19, is reflected upwardly out of the support 19 and onto the underside of the food 12, thereby effecting browning of this underside region. By rotation of the turntable 2, it can thus be envisaged that a substantial portion of the underside of the food 12 can be browned by this arrangement.

The support 19 or the lamp assemblies 4 and 5 may be provided with a lens or other means for concentrating the infra-red radiation onto the reflective surface 21.

In FIG. 2, another support 23, located between the turntable 2 and the food 12, is made from an infra-red-transmissive or thermally-conductive material and contains a fluid heat transfer medium 24.

When the support 23 is irradiated with infra-red radiation 22 and the turntable 2 is rotated, heat from the radiation is conveyed by the medium 24 to the underside of the food 12 to effect browning thereof. The support 23 therefore acts as a fluid heat pipe, which can conduct heat considerably more rapidly than a metallic conductor.

As with the embodiment shown in FIG. 1, the support 23 or the lamp assemblies 4, 5 may be provided with a lens assembly or other means to concentrate the radiation 22 onto the support to increase heat transfer to the food 12.

In the embodiments described, the infra-red radiation from the lamp units is used to brown food cooked by microwave energy. However, in another embodiment, the oven does not necessarily include a microwave source and the infra-red radiation from the lamp units is utilised to grill food placed in the oven cavity. As another alternative embodiment, the oven can include, in addition to the tungsten-halogen lamp units, a conventional radiant electric resistive heating element 30 to cook the food by convection. Alternatively, the oven can include, in combination, a microwave source, a radiant heating element, and the tungsten-halogen lamp units for grilling or browning food, which can be energised independently or concurrently.

Figure 3:
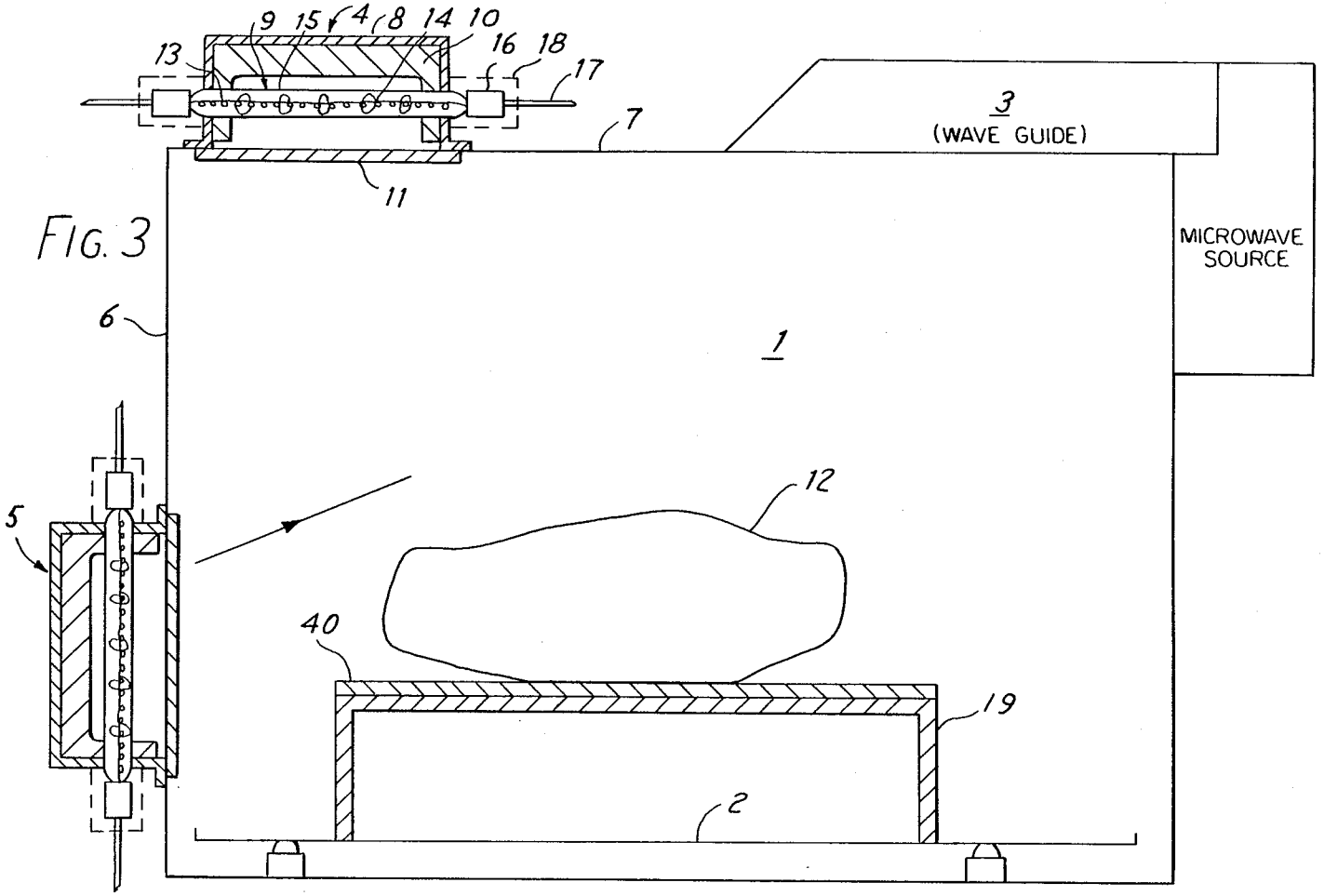
FIG. 3 shows schematically a third embodiment of the invention.

Referring to FIG. 3, another embodiment to achieve underside browning of food in a microwave oven may consist of a microwave-absorbent coating 40 deposited on a support or utensil for the food adjacent the underside of the food, so that microwave energy absorbed by the coating produces heat for browning the food.

The support may be removable from the oven or variably positioned within the oven cavity to achieve optimum browning.

The present oven therefore provides uniform browning or grilling of food, including regions thereof obscured from direct exposure to the infra-red radiation, such as underside regions of the food.

I claim:

1. An oven comprising an oven cavity, at least one tungsten-halogen lamp emissive of infra-red radiation, and a support arranged to support food within the oven cavity, said at least one tungsten-halogen lamp being positioned within the oven cavity to directly expose a region or regions of food, supported on the support, to infra-red radiation from the lamp thereby to brown or grill the exposed region or regions of the supported food, wherein said support incorporates fluid heat transfer means arranged to absorb heat from infra-red radiation produced by said at least one tungsten-halogen lamp and for conveying absorbed heat to a further region or regions of the food, supported on the support, which are obscured from direct exposure, thereby to brown or grill said further region or regions.

2. An oven according to claim 1 wherein said fluid heat transfer means comprises a substantially hollow body containing a fluid heat transfer medium.

3. An oven according to claim 1 and including a source of microwave energy arranged to cook food supported on said support.

4. An oven according to claim 1 including a radiant resistive heating element arranged to cook food supported on said support.

5. An oven according to claim 1 including a turntable arranged to rotate said support relative to said at least one tungsten halogen lamp.

* * * * *